United States Patent [19]

Lew

[11] 4,052,070

[45] Oct. 4, 1977

[54] VARIABLE TENSION RING EXERCISER

[76] Inventor: Hyok Sang Lew, 7890 Oak St., Arvada, Colo. 80005

[21] Appl. No.: 379,413

[22] Filed: July 16, 1973

[51] Int. Cl.[2] ..... A63B 21/12

[52] U.S. Cl. ..... 272/120; 272/24

[58] Field of Search ..... 272/24.60 R, 62, 63, 272/79 R, 80, 82, 120; 35/29 R; 128/70–75; 182/3–9; 297/274, 275, 385; 244/151 R

[56] References Cited

U.S. PATENT DOCUMENTS

| | | | |
|---|---|---|---|
| 843,478 | 2/1907 | Muller | 272/80 |
| 1,374,697 | 4/1921 | Werndli | 272/82 |
| 1,675,552 | 7/1928 | Hawxhurst | 272/80 |
| 3,432,163 | 3/1969 | Murphy | 272/60 |

FOREIGN PATENT DOCUMENTS

| | | | |
|---|---|---|---|
| 829,380 | 1938 | France | 128/75 |
| 1,321,733 | 12/1963 | France | 272/80 |
| 279,927 | 4/1952 | Switzerland | 272/80 |

*Primary Examiner*—Anton O. Oechsle

[57] ABSTRACT

A variable tension ring exerciser having two rings for hand grips and a belt securable to the lower torso of the exercising person and including means of sheaves and ropes disposed intermediate the rings and the belt, therefrom the rings and the belt are suspended and, whereby, a pulling force exerted on the rings hoists the belt, provides an exercising apparatus. The means of sheaves and ropes disposed intermediate the rings and the belt includes means of adjusting the tension on the rings induced by the weight of the exercising person from a fraction to a multiple of the weight of the exercising person.

4 Claims, 5 Drawing Figures

VARIABLE TENSION RING EXERCISER

The present invention relates to an exercising apparatus and, more particularly, to a ring exerciser including means of adjusting the tension on the rings.

In order to develop or maintain physical fitness, the home exerciser is desirable to people, who have only a limited access to a gymnasium. The means or method of home exercise available at the present time is limited to a few, which are less than ideal because of the lack of excitement and challenge it provides to exercisers. The push-ups and chin-ups are more or less a method of exhaustion instead of an exercise to many non-atheletes, who find themselves exhausted before doing any sizable number of ups and downs. The weight lifting, dumbbells and spring pulls do not provide much excitement and satisfaction to many non-atheletes because of the lack of coordinated motion involving all parts of the body in such exercises. There are exercises such as parallel bars, nonparallel bars and rings providing exercises, which employ coordinated movement of all parts of the body. However, these exercises demand a physical strength, which many people in need of exercise do not afford. These exercises employ apparatus of bulky structure, which are often unacceptable to average homes.

It is therefore a primary object of the present invention to provide an exerciser employing a variety of coordinated motion involving all parts of the body.

Another object of the present invention is to provide an exerciser having adjustable tension or load of exercising.

Still another object of the present invention is to provide an exerciser using the weight of the exercising person as the source of tension or load used in exercising.

Yet another object of the present invention is to provide an exerciser sustaining the exercising person in midair during the exercise.

A further object of the present invention is to provide an exerciser sufficiently succint to set up in average homes.

A yet further object of the present invention is to provide an exerciser usable by atheletes as well as non-atheletes.

These and other objects of the present invention will become apparent to those skilled in the art as the description thereof proceeds.

The present invention may be described with greater specificity and clarity with reference to the following drawings, in which.

Figure 1:
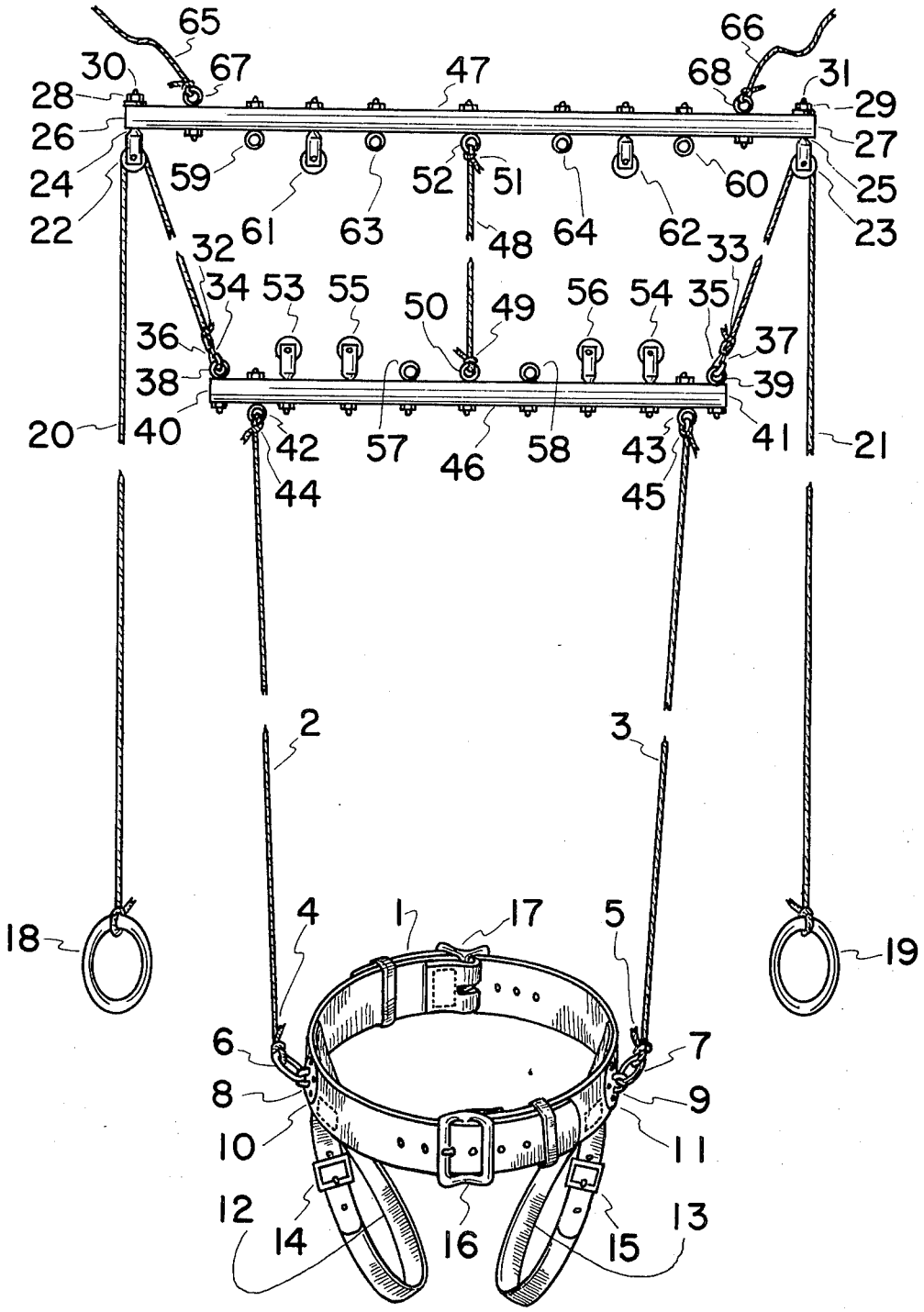
FIG. 1 illustrates an isometric view of the present invention.

Referring to FIG. 1, there is shown in a variable tension ring exerciser constructed in accordance with the present invention. The belt 1 is connected to a bar 46 by a pair of ropes 2 and 3. One end 44 of rope 2 is secured to an extremity 40 of bar 46 by means of an eye bolt 42 affixed to bar 46. The other end 4 of rope 2 is secured to a small ring 6, which small ring engages an eye hole 8 affixed to belt 1 at a side position 10. Another eye hole 9 is affixed to belt 1 on a position 11, which position is diametrical to position 10. An end 5 of rope 3 is secure to a small ring 7, which small ring engages eye hole 9. The other end 45 of rope 3 is secured to an extremity 41 of bar 46 by means of an eye bolt 43 affixed to bar 46. The belt 1 includes a buckle 16 positioned at the middle of the front half of the belt. Another buckle 17 is disposed at the middle of the rear half of the belt. The belt 1 includes a pair of straps 12 and 13. Ends of strap 12 are affixed to belt 1 intermediate front buckle 16 and eye hole 8, and intermediate rear buckle 17 and eye hole 8, respectively. Similarly, ends of strap 13 are affixed to belt 1 intermediate front buckle 16 and eye hole 9, and intermediate rear buckle 17 and eye hole 9, respectively. Straps 12 and 13 have means 14 and 15 of adjusting their length, respectively.

A rope 20 having a ring 18 attached to one end for a hand grip engages a pulley 22, which pulley is attached to an extremity 26 of a bar 47. A bolt 30 extending from pulley 22 rotatably engages a hole 24 disposed within bar 47 and a nut 28 frictionally engages bolt 30. The other end 32 of rope 20 is removably secured to an extremity 40 of bar 46 by means of a hook 34 having a lock 36, which hook engages an eye bolt 38 affixed to bar 46. Another rope 21 having a ring 19 attached to one end for a hand grip engages a pulley 23, which pulley is attached to an extremity 27 of bar 47. A bolt 31 extending from pulley 23 rotatably engages a hole 25 disposed within bar 47 and a nut 29 frictionally engages bolt 31. The other end 33 of rope 21 is removably secured to an extremity 41 of bar 46 by means of a hook 35 having a lock 37, which hook engages an eye bolt 39 affixed to bar 46.

A rope 48 having end 49 secured to the middle of bar 46 by means of an eye bolt 50 affixed to bar 46 and end 51 secured to the middle of bar 47 by means of an eye bolt 52 affixed to bar 47, limits the extent of lateral motion of bar 46 with respect to bar 47 away from each other. A plurality of sheaves 53, 54, 55 and 56 and a plurality of eye bolts 57 and 58 are disposed along bar 46 symmetrically with respect to the middle point of bar 46. Similarly, a plurality of sheaves 61 and 62, and a plurality of eye bolts 59, 60, 63 and 64 are disposed along bar 47 symmetrically with respect to the middle point of bar 47. Bar 47 includes means of securing it to an over-hanging structure such as a beam or a branch of a tree, which securing means is represented by a pair of ropes 65 and 66 secured to bar 47 by means of eye bolts 67 and 68, respectively, affixed to a proximity of each of extremities 26 and 27 of bar 47.

Figure 2:
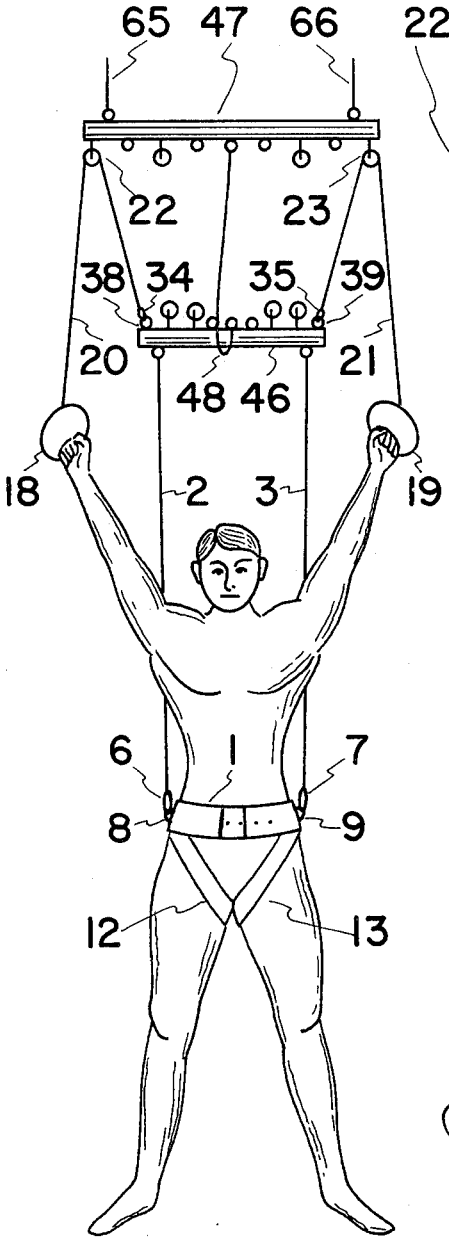
FIG. 2 illustrates the present invention being used in doing pull-ups in up-right position.
Figure 3:
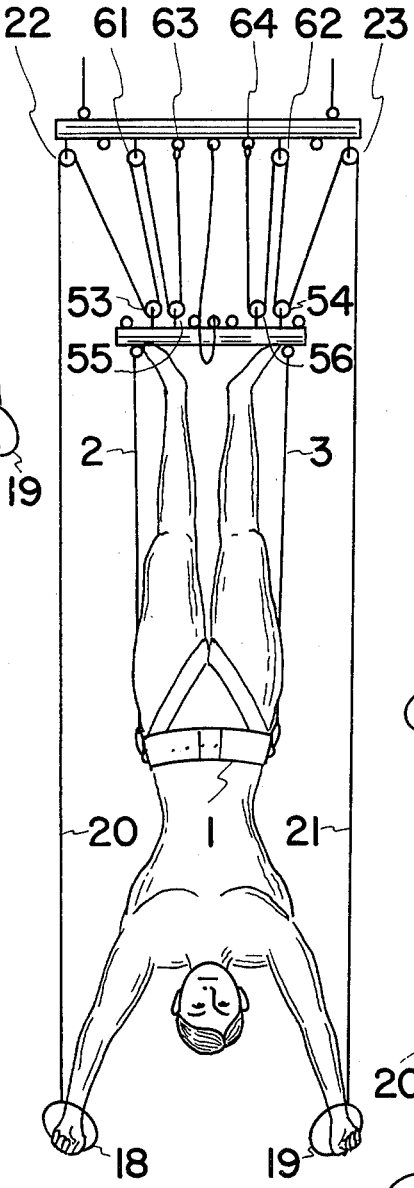
FIG. 3 illustrates the present invention being used in doing push-ups in inverted position.
Figure 4:
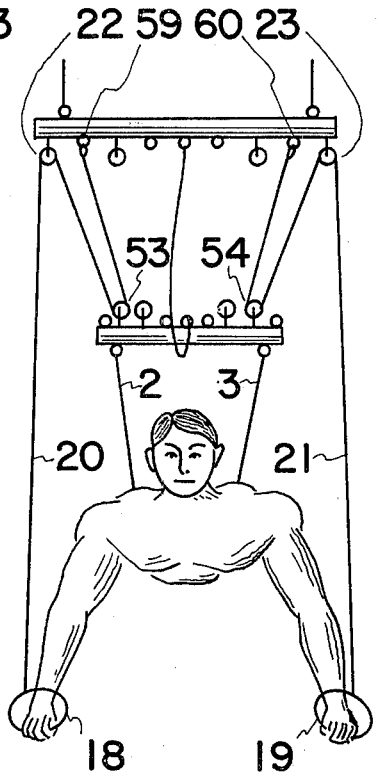
FIG. 4 illustrates the present invention being used in doing push-ups in prone position.
Figure 5:
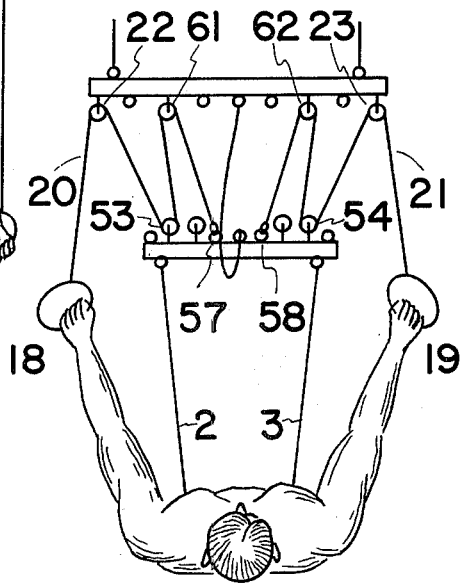
FIG. 5 illustrates the present invention being used in doing pull-ups in supine position.

The operation of the variable tension ring exerciser, as illustrated in FIG. 1, will be described with reference to FIGS. 2, 3, 4 and 5. There is shown in FIG. 2 an exercising person doing pull-ups in the up-right position by using the variable tension ring exerciser. Bar 47 is secured to an existing over-hanging structure by means of ropes 65 and 66. Belt 1 is secured to the lower torso of the exercising person by means of the belt secured around the waist and straps 12 and 13 secured around both thighs of the exercising person. Means 16 and 17 of adjusting length of the belt and means 14 and 15 of adjusting lengths of two straps are used to secure belt 1 to the exerciser's body comfortably. The tension exerted on ropes 20 and 21 by the pulling force of exerciser's hands gripping rings 18 and 19 counter balances the weight of the exercising person and thus sustains the body of the exercising person in midair during the exercise. By using locks 36 and 37 included in hooks 34 and 35, respectively, an exercising person can engage or disengage these hooks to or from any eye bolts disposed along bar 46 and 47. By employing an appropriate combination of sheaves and eye bolts in linking ropes 20 and 21 to bar 46, an exercising person can adjust the tension on ropes 20 and 21 from a fraction to a multiple of his body weight. For the particular combination of linking shown in FIG. 2, the tension on each of ropes 20 and 21 is approximately equal to half of the exercising person's weight. By engaging hook 34 and eye bolt 39 instead of 38, and hook 35 and eye bolt 38 instead of 39, an exercising person can increase the tension on ropes 20 and 21 to a value sizably greater than his body weight. Examples of lowering the tension on ropes 20 and 21 are illustrated in FIGS. 3, 4 and 5. The up-right position of the exercising person shown in FIG. 2 can be also used in doing push-ups. First pulling both rings 18 and 19 to the waist level and then bringing them to the proximity of arm pits, an exercising person can do push-ups by repeating such movements.

There is shown in FIG. 3 an exercising person doing push-ups in the inverted position by using the variable tension ring exerciser. An exercising person can do pull-ups in the inverted position by employing the inverted version of procedure of doing push-ups in the up-right position, which was described with reference to FIG. 2. For the particular combination of linking shown in FIG. 3, the tension on each of ropes 20 and 21 is approximately equal to one eighth of the exercising person's weight.

There is shown in FIG. 4 an exercising person doing push-ups in the prone position by using a tension on each of ropes 20 and 21 approximately equal to a quarter of the exercising person's weight. It is not difficult to imagine that the prone position shown in FIG. 4 can be also used to do butterfly exercise by fluttering both arms in unison.

There is shown in FIG. 5 an exercising person doing pull-ups in the supine position by using a tension on each of ropes 20 and 21 approximately equal to one sixth of the exercising person's weight.

Again referring to FIG. 1, rope 48 having one end secured to bar 46 and other end secured to bar 47 limit the distance of separation of bar 46 away from bar 47 and thus prevents the exercising person from falling to the floor when the hand grip on either of rings 18 or 19 is accidentally lost. Locks 36 and 37 included in hooks 34 and 35, respectively, prevent these hooks from accidentally disengaging from eye bolts. Front and rear buckles 16 and 17 are used to adjust lengths of the front and rear half of belt 1, respectively, so that ropes 2 and 3 extend from two diametrical sides of the waist of a person wearing the belt. Straps 12 and 13 aid in keeping belt 1 secured around the waist of a person wearing it by preventing the belt from sliping upward. Two small rings 6 and 7 linking ropes 2 and eye hole 8, and rope 3 and eye hole 9, respectively, prevent each of ropes from kinking, respectively.

It becomes apparent from the description of the function of sheaves disposed along bars 46 and 47 that the simple sheaves embodied in FIG. 1 may be replaced by double or triple sheaves as they are employed in many commercial rope hoists.

It is apparent from the description of the operation of the variable tension ring exerciser that an exercising person can use it to do all exercises conformable to the conventional ring exerciser as well as many other exercises. By using various transitions from one exercise to another or different combinations of exercises shown in FIGS. 2, 3, 4 and 5, a person can do a great variety of exercises involving almost every body movement employed in gymnastics. A person can do many maneuvers conformable to exercises using the parallel bars and rings by using a strength he affords, when the variable tension ring exerciser is used.

While the principles of the invention have now been made clear in an illustrative embodiment, there will be immediately obvious to those skilled in the art many modifications of structure, arrangements, proportions, the elements, materials and components used in the practice of the invention which are particularly adapted for specific environments and operating requirements without departing from those principles.

I claim:

1. A variable tension ring exerciser for physical training, said exerciser comprising:

a first bar including a first pulley disposed within one extremity of said first bar and a second pulley disposed within other extremity of said first bar;

a first ring secured to one end of a first rope, said first rope engaging said first pulley;

a second ring secured to one end of a second rope, said second rope engaging said second pulley;

a belt securable to the lower torso of an exercising person, said belt including;

a. a first means of adjusting the length of the front half of said belt;

b. a second means of adjusting the length of the rear half of said belt;

c. a first strap securable around one thigh of a person wearing said belt; whereby, said first strap prevents said belt from slipping upward; and d. a second strap securable around other thigh of a person wearing said belt; whereby, said second strap prevents said belt from slipping upward;

a third rope attached to said belt intermediate said first and second means of adjusting the length of said belt;

a fourth rope attached to said belt diametrically to said third rope;

a first mechanically advantageous hoist means linking said first and third ropes; whereby, pull of said first ring hoists said belt;

a second mechanically advantageous hoist means linking said second and fourth ropes, whereby, pull of said second ring hoists said belt;

wherein said first and second hoist means providing mechanical advantage include means of varying tensions on said first and second ropes, said tensions caused by the weight attached to said belt;

wherein a plurality of sheaves disposed along said first bar constitute part of said hoist means providing mechanical advantage; and wherein a second bar is disposed intermediate said first bar and said belt, said second bar including:

a. said third rope extending from said belt secured to one extremity of said second bar;

b. said fourth rope extending from said belt secured to other extremity of said second bar; and c. a plurality of sheaves disposed along said second bar constituting part of said hoist means providing mechanical advantage.

2. The combination as set forth in claim 1 wherein a fifth rope having one end secured to the middle of said first bar and other end secured to the middle of said second bar limits the separation of said bars from each other to a desirable distance.

3. The combination as set forth in claim 2 wherein said first and second ropes extending from said rings are securable to said bars; whereby, said first and second ropes can engage various combinations of said sheaves.

4. A variable tension ring exerciser for physical training, said exerciser comprising:

a first bar including a first pulley disposed within one extremity of said first bar and a second pulley disposed within other extremity of said first bar;

a first ring secured to one end of a first rope, said first rope engaging said first pulley;

a second ring secured to one end of a second rope, said second rope engaging said second pulley;

a belt securable to the lower torso of an exercising person, said belt including:

a. a first means of adjusting the length of the front half of said belt;

b. a second means of adjusting the length of the rear half of said belt;

c. a first strap securable around one thigh of a person wearing said belt; whereby, said first strap prevents said belt from slipping upward, and d. a second strap securable around other thigh of a person wearing said belt; whereby, said second strap prevents said belt from slipping upward;

a third rope attached to said belt intermediate said first and second means of adjusting the length of said belt;

a fourth rope attached to said belt diametrically to said third rope;

a first mechanically advantageous hoist means linking said first and third ropes, whereby, pull of said first ring hoists said belt; and a second mechanically advantageous hoist means linking said second and fourth ropes; whereby, pull of said second ring hoists said belt;

wherein said first and second hoist means providing mechanical advantage include means of varying tensions on said first and second ropes, said tensions caused by the weight attached to said belt; and wherein said hoist means providing mechanical advantage and including means of varying said tension comprise:

a. a first multiple sheave means secured to said first bar near one extremity of said first bar;

b. a second multiple sheave means secured to said first bar near the other extremity of said first bar;

c. a third multiple sheave means secured to the end of said third rope extending from said belt;

d. a fourth multiple sheave means secured to the end of said fourth rope extending from said belt;

e. said first rope selectably engaging said first and third multiple sheave means; whereby, said tension on said first rope is varied as said first rope engages various combinations of sheaves included in said pair of multiple sheave means; and f. said second rope selectably engaging said second and fourth multiple sheave means; whereby, said tension on said second rope is varied as said second rope engages various combinations of sheaves included in said pair of multiple sheave means.

* * * * *